US005415414A

United States Patent [19]

Savage

[11] Patent Number: 5,415,414

[45] Date of Patent: May 16, 1995

[54] METHOD OF PLAYING A CASINO CARD GAME

[75] Inventor: Allen L. Savage, Las Vegas, Nev.

[73] Assignee: Casino Advisory Services, Inc., Las Vegas, Nev.

[21] Appl. No.: 165,393

[22] Filed: Dec. 10, 1993

[51] Int. Cl.[6] ..... A63F 1/00

[52] U.S. Cl. ..... 273/306; 273/292

[58] Field of Search ..... 273/292, 303, 306, 274

[56] References Cited

U.S. PATENT DOCUMENTS 4,440,398 4/1984 Charon ..... 273/292

5,098,107 3/1992 Boylan et al. ..... 273/292

*Primary Examiner*—Benjamin H. Layno

*Attorney, Agent, or Firm*—Quirk & Tratos

[57] ABSTRACT

A card game is described which uses a standard fifty-two card playing deck plus at least one additional unique card. Player's winning hands are determined by comparison to the Dealer's hand. Additional winning hands for the Players are identified as four different ranks of four different suits, plus the unique card, but with no pairs allowed. This winning hand is always paid by the Dealer regardless of the value of the Dealer's hand.

12 Claims, 2 Drawing Sheets

METHOD OF PLAYING A CASINO CARD GAME

BACKGROUND OF THE INVENTION

Poker and other card games have been played as leisure time activities by the public for many years. Many variations on the standard five card poker game are played by the public. In most of these games, the basic rules of card priority and rank are consistent for designating a winning poker hand. This commonly-used rank order of "winning" hands in five card poker is as follows: Royal Flush, Straight Flush, Four of a Kind, Full House, Flush, Straight, Three-of-a-kind a-Kind, Two Pair, One Pair, and "High Card in Hand." However, because of the complexities of poker, and the difficulty in calculating table odds, it has rarely been introduced as a casino table game in which each player is pitted against the house.

Conventional poker games involve multiple players each being dealt a hand by a dealer. The player still remaining at the conclusion of all betting, with the highest hand, wins. Draw poker is a variation of the standard game, wherein after the initial cards are dealt, the players have an opportunity to trade in (discard) some number of the cards in their hand for new cards from the dealer.

In many establishments that have allowed legalized gaming, the house "hosts" the game by providing: the dealer; the playing table; the chairs; and the cards, but is not involved in the wagering. In some cases the house collects a small percentage of every winning bet to compensate for providing the facilities. In other instances, the house collects a small percentage of each player's bet (the "rake"). The various payment schemes are a direct result of the fact that, in the majority of casinos, players do not compete against the house, but rather against other players in the group.

Many people find this type of casino poker unappealing for exactly this reason. By competing against fellow players and friends, but not the house, the money paid to the winners comes not from a distant, impersonal entity, "the house", but rather from the fellow players and friends. This makes many "occasional" gamblers uncomfortable. For this reason, most of the popular casino games involve players being in competition against the house.

Another deficiency of casino card room poker is that there are no bonus payments for particularly good hands. For example, royal flushes are a very rare occurrence, but the winning player with this hand collects exactly the same amount as a winning player collecting with only two pair. The majority of winnings in poker result from successful bluffing strategies during the betting round. This too discourages the "occasional" gambler. In addition, standard poker games do not provide a way for the player to win large payoffs as in other casino games. For this reason, there exists a need for a poker game that pits the players against the house and involves additional payments for particularly good hands, as well as the opportunity to win "sweepstakes" payoffs. It is an object of the invention to provide such a game.

BRIEF SUMMARY OF THE INVENTION

One embodiment of the present invention is a new draw card game wherein a dealer uses a standard 52-card deck plus at least one additional, "unique" card. The unique card has no assigned rank or value, nor is it a wild card. Winning hands in the card game of the present invention consist of standard five card poker hands in rank order (i.e., Royal Flush, Straight Flush, Four-of-a-Kind, Full House, Flush, Straight, Three-of-a-Kind, Two Pair, One Pair and High card), plus an additional, "defined" winning hand. In one preferred embodiment, the "defined" hand has been labeled a "PADUKEE" hand, and consists of four different ranks, in each of the four different suits, plus the "unique" card, with no pairs allowed. This hand will be paid by the dealer regardless of the value of the dealer's hand. The dealer passes out cards as if the game were a standard five card draw game; however, if one of the players has the "Padukee" hand, that player wins against the dealer. Bonuses are awarded to Players having Padukee hands that comprise Three-of-a-Kind or better ranks.

In another embodiment of the present invention, the dealer passes out cards from a standard 52-card deck, wherein the deck has an additional unique card that has no rank or value, nor is the card wild. Each player makes a first bet (ante) and is then dealt five cards by the dealer face-down. After passing out the player's cards, the dealer takes one card face-up. If this card is the Padukee card, the Dealer automatically loses the hand, and each player is paid an amount equal to their ante. Additionally, players with Three-of-a-Kind or better are paid a bonus amount consisting of a posted multiple of the ante. If the Dealer does not draw a Padukee card, this first face-up card is considered to be a pair of that card's rank.

The players are now given the option of forfeiting their cards, or betting an additional amount (call bet) to stay in the game. Players that forfeit their cards sacrifice the initial bet to the house. Players that choose to stay in the game have the option of receiving additional cards after making their call bet. The additional cards are dealt in a manner consistent with well known draw poker games. Once the players have made their second bet and traded in unwanted cards, the dealer draws three additional cards face-up.

If any of these cards are the Padukee card, the dealer automatically loses. If the dealer does not draw a Padukee card, the game continues with each player comparing his cards to the dealers cards by well known rules of poker hand rank. The first card drawn by the dealer, however, is still considered to be a pair. The dealer's four card hand is therefore effectively worth five cards since the first face-up card is considered to be a pair. If, however, any player has a Padukee hand, defined as consisting of four cards of four different ranks and four different suits plus the unique card, that player automatically wins.

Winners against the Dealer are paid an amount equal to the ante and the call bet combined. In an alternative embodiment, players that show Three-of-a-Kind or better are paid an amount equal to their ante, plus a posted multiple of their call.

DETAILED DESCRIPTION OF THE INVENTION

Figure 1:
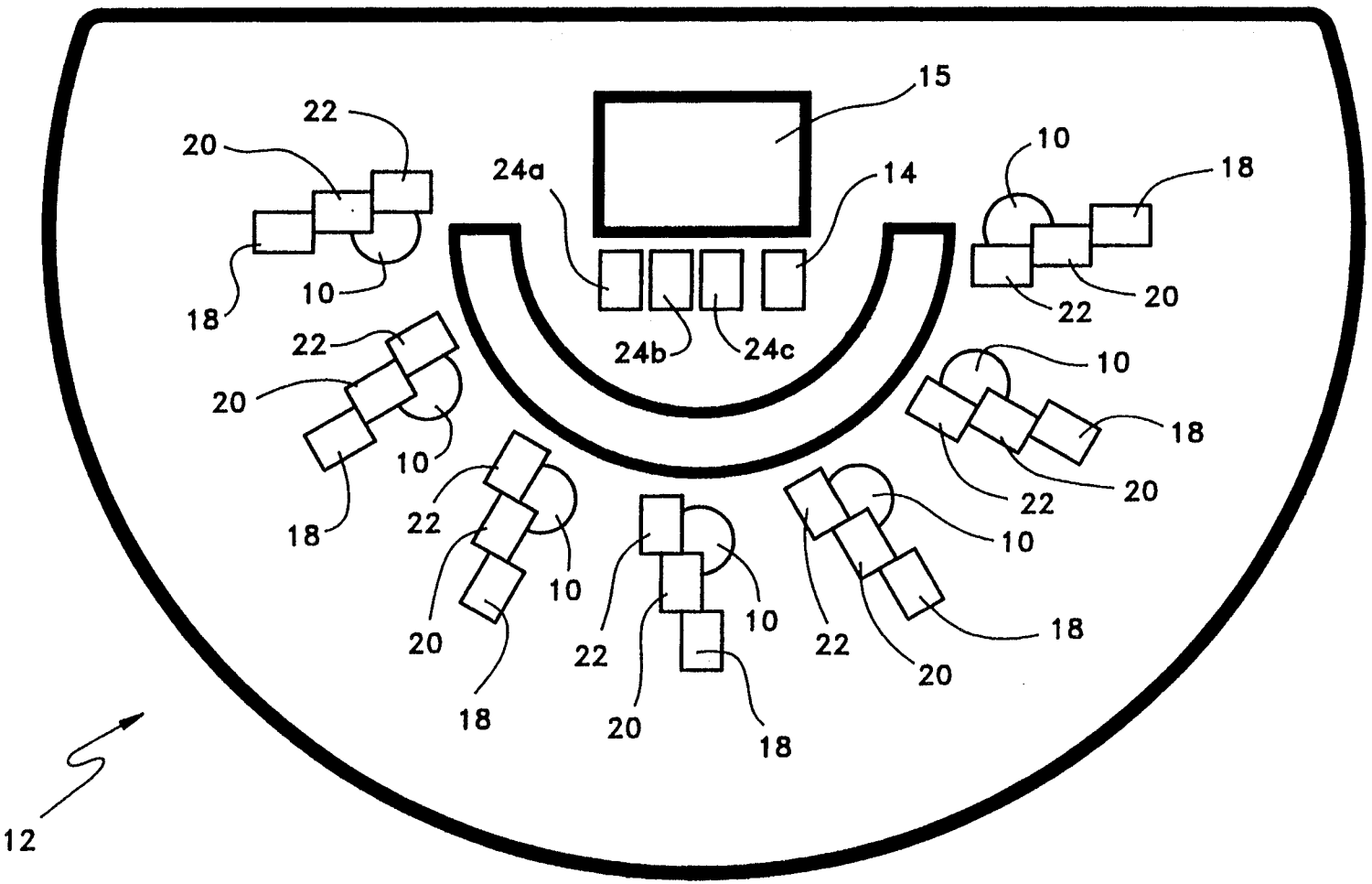
FIG. 1 is a diagram of a typical playing surface layout for a preferred embodiment of the card game described by this invention.
Figure 2:
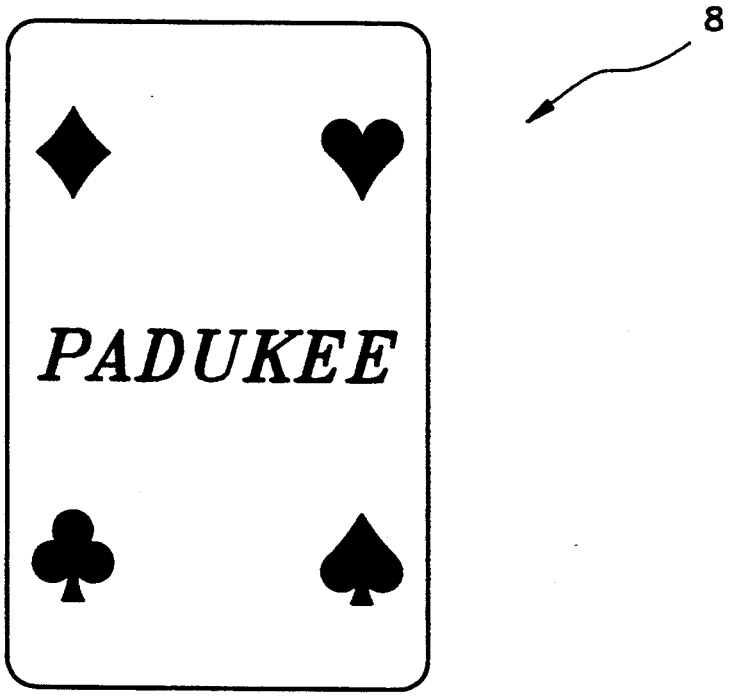
FIG. 2. is a front view of a unique card of the present invention, the card having no rank, no value, and not being wild.

The present invention is a new casino draw game wherein a dealer uses a card deck consisting of the fifty-two standard playing cards, plus a unique card 8 having no rank, no value, nor is it wild. In the presently-preferred embodiment, the unique card is termed the "PADUKEE" card. The uniqueness of this game revolves around the use of the standard deck in combination with at least one additional Padukee card. In the broadest sense, the game of the present invention is a card game, wherein an additional winning hand or hands involving the Padukee card are predetermined. In one embodiment, "a Padukee hand" is defined as a set of five cards having four cards with different ranks and of different suits plus the Padukee card. In this embodiment, the Padukee hand automatically wins against every other hand.

It can be appreciated that while the "Padukee" hand of this embodiment consists of four different ranks of four different suits, plus the unique card, other "Padukee" hands could be designated by those with skill in the art. For instance, the "Padukee" hand might consist of four cards of the same rank, with each card being a different suit, in addition to the unique card. Similarly, a "flush Padukee" hand is anticipated wherein the winning cards consist of four cards of the same suit, but having different ranks, in addition to the "Padukee" card. Many other "Padukee" hands are anticipated, and are within the scope of the present invention.

The card game of the present invention should also not be considered as limited to only five card draw table games as described in the preferred embodiment. Other card games are contemplated wherein the card deck has fifty-two standard playing cards, plus at least one unique card. For example, seven card table games are also within scope of the present invention, as are five card non-draw games.

It can be appreciated that most of the embodiments of the present invention can be rapidly converted from draw card games to "stud" card games. For example, in five card stud, the players are not given the option of trading for new cards after making their bets. The common factor in all of these games of the present invention is the use of a unique card which, when in combination with other specific cards, results in a winning hand.

The present invention is also not limited to only poker games. For example, a card deck having fifty-two standard playing cards plus at least one additional unique (e.g., "Padukee") card might be used for many different card games. One such game is called "in-between" wherein the object is to anticipate whether a third card drawn will possess a rank between the first two cards drawn. In this game, for example, the "Padukee" card might be designated as either a high or low card, at the players discretion. This would add to the enjoyment of playing "in-between" by increasing the odds of winning by the player.

An additional card game related to the present invention would be "Padukee blackjack." In this game a dealer deals cards from a deck having fifty-two standard playing cards, plus one unique card that is not a wild card. Predetermined hands wherein a player having, for instance, four cards plus the Padukee card, wherein the total value of all the ranks was less than 21, could be designated as automatically paid by the dealer. Other blackjack-type games are also anticipated. For example, the predetermined hands might have less than four cards, with the total of all the ranks being less than twenty-one. Alternatively, more than one Padukee hand might be placed in the deck so that hands comprising at least one Padukee card, plus a predetermined number of other cards (the total of all the ranks adding up to a cumulative value of less than twenty-one), would be automatically paid by the dealer. Certain hands could also be chosen that would be paid as major jackpot winners. For instance, card games are envisioned wherein players having very rare Padukee blackjack hands might be paid relatively large sums of money. This feature would add to the enjoyment of the game since each player would be give the opportunity to win a relatively large jackpot simply by playing the blackjack game.

In the preferred method of the invention, a standard fifty-two playing card deck is supplemented with only one Padukee card; however, other embodiments of the game exist wherein multiple Padukee cards are in play at the same time. When made part of specific, predetermined hands, the Padukee card results in an instant win. For instance, in the preferred embodiment, a hand consisting of four cards of different suits plus one Padukee card leads to an instant win when only one Padukee card is in the deck. When multiple Padukee cards are in the deck, either all of the Padukee hands are declared winners, or some Padukee hands are predetermined to beat other Padukee hands.

In the Dealer's hand, the Padukee card always leads to an instant loss in the preferred embodiment. However, other embodiments of the present invention exist wherein the dealer does not lose after drawing a Padukee card, but simply competes with each player to determine the winner. The use of the Padukee card in the card game of the present invention will become more apparent in light of the following detailed description.

DESCRIPTION OF THE PREFERRED EMBODIMENT

In the preferred embodiment of this game, Padukee Draw is played with a card deck consisting of 52 standard playing cards (in four suits or colors) with each suit consisting of cards having face values of: 2, 3, 4, 5, 6, 7, 8, 9, 10, along with the pictures cards Jack, Queen, and King, and an Ace. The deck also includes one additional card designated as the "Padukee," resulting in a preferred Padukee card deck of fifty-three cards. As is conventionally the case, the backs of all cards, including the Padukee card, are all substantially identical. However, the Padukee card is provided with unique markings on its face, distinguishing it from the other standard fifty-two cards in the deck. For example, the joker that normally accompanies a new deck of cards could be used as the Padukee card. In this manner, unless the face of a card is visible, a player cannot tell which card(s) in the deck is the Padukee card.

In Padukee Draw, a single dealer is pitted against multiple players, with winners and losers being determined by comparing each individual player's hand to that of the dealer/house. This differs from standard five card draw where the players are all pitted against one another, and the dealer/house takes a percentage of the winnings or bets placed in every hand. Although the preferred means of playing Padukee Draw is on a table as is shown in FIG. 1, any type of surface can be used to play the game. Similarly, although the following describes a game wherein only one deck is used by the dealer, it can be appreciated that multiple decks (i.e., a shoe) can also be used to play the game.

The following description specifically sets out the rules of playing Padukee Draw. Alternative methods of playing the game will be discussed in the following sections. In Padukee Draw, the Padukee card is used in two ways:

A. To create a "Padukee" hand for the player, defined as four different ranks in four different suits, plus the Padukee card but no pairs, wherein the Player with a Padukee hand is automatically paid by the dealer;

B. In the dealer's hand, to designate the dealer's hand as automatically dead.

As discussed above, a Padukee hand for the player involves four different ranks in four different suits (i.e., heart, spade, diamond, club) plus the Padukee card, but no pairs. This five card hand is always paid by the dealer regardless of the dealer's hand. An example of a player's winning Padukee hand is as follows:

| ACE (Hearts) | KING (Spades) | QUEEN (Clubs) | JACK (Diamonds) | Padukee card |
|---|---|---|---|---|

Other winning Padukee hands involve any combination of 4 different ranks in four different suits with the Padukee card, with no pairs allowed. These alternative winning hands can be determined by one of ordinary skill in the art, without being specifically outlined herein.

As discussed above, the Padukee card in the dealer's hand automatically renders the dealer's hand "dead." In this case, all of the players still remaining in the game win. This feature adds to the enjoyment of the game, as it increases the odds of the dealer/house losing the hand.

In the first step of Padukee Draw, each player makes an initial bet (ante) to begin the game. This bet identifies those individuals interested in playing. The bet from each player is placed in a specific one of a plurality of ante circles 10, inscribed on a playing surface Table 12, as shown in FIG. 1. The dealer then deals the playing cards, one at a time, from a well-shuffled deck. Starting with the player to the dealer's left, one card is dealt face-down to each player from left to right. A second round is started with another card dealt face-down to the player on the dealer's left side, and again continuing with face-down cards to each of the other players (from left to right). This action is repeated until each player has five face-down cards. The players are now free to pick up and examine the different values of their cards, but should do so in a manner as to not show them to the other players.

After the player's cards are dealt, the dealer takes only one card from the top of the deck, which is turned face-up. This card is placed on the Table 12 at a central position 14, and creates the first potential pay-off opportunity in the game. If the dealer's up-card at position 14 is the Padukee card, the dealer's hand is declared automatically dead and all players in the game become winners. Players receive an award equal to their ante from the dealer/house (i.e., a 1-to-1 payout). To pay each player, the dealer removes chips from a chip rack 15 (the Figure depicts the <position> of the chip rack 15 and not the rack itself. To further increase the thrill of the game in a preferred version, a player who has Three-of-a-Kind or better in his or her hand is also given a bonus award. Although such award may be a "fixed" sum, preferably the amount of the bonus award is determined as a multiple of the ante, and posted at the table. An example of such bonus award payouts for Three-of-a-Kind or better hands are listed below in TABLE 1.

TABLE 1

| Payouts on Three of a Kind or Better As A Multiple of the Wager | |
|---|---|
| Royal Flush | 200:1 |
| Straight Flush | 20:1 |
| 4-of-a-Kind | 15:1 |
| Full House | 8:1 |
| Flush | 6:1 |
| Straight | 4:1 |
| Padukee | 3:1 |
| 3-of-a-Kind | 1:1 |

For instance, if on the first hand a player draws three Kings and two fours (i.e., a full house), and the dealer draws the Padukee card, the player wins the posted multiple of the ante (see TABLE 1) in place of the normal, even-money payout. After the dealer has drawn the Padukee card, that game is over and an entirely new game is begun. All of the players' cards are returned to the dealer, and the deck is re-shuffled. The dealer then hands out five new face-down cards to each betting player at the table 12, from left to right, as was discussed above.

If the dealer's up-card is not the Padukee card, the game continues. In the preferred embodiment of this game, the first card drawn by the dealer is declared to be a pair of that rank in the dealer's hand. Again, this card is preferably placed in the central position 14 of the table 12. The central position 14 can be marked to state that any card residing therein is to be considered a pair. For instance, if the dealer's up-card was a Four, that one card would be placed in position 14 and considered as a pair of Fours when compared to each player's hand. If, later in the game, the dealer draws another Four, his hand would be considered to have three of a kind, even though only two Fours would be present. Only the first card drawn by the dealer, and subsequently placed in position 14 is considered to be a pair.

The players must now decide if their respective cards can beat a pair consisting of the dealer's up-card. At this point in the game, the players have four options available. In option (1) the player does not make an additional bet (call bet) and must surrender his or her cards. This player's ante is collected from the ante circle 10 by the dealer and that player is out of the game. This option is normally only used in cases wherein the player doesn't see any way of beating the dealer's pair. In option (2) the player places a bet equal in value to the original ante (termed hereafter a "call bet") in a call/no card position 18, but doesn't request any additional cards. In option (3) the player makes a call bet and requests one card. After placing the call bet in a call/one card position 20 on the table 12, the player surrenders one card by placing it in a call/one card position 20 and is then dealt a card from the deck by the dealer. This new card is then incorporated into the player's hand and used to compete against the dealer in the final round. In the last option (4) the player places a call bet in a call/two card square 22 of the table 12 and requests two new cards. The player first places the call bet on the table and then surrenders two cards from his hand.

Following surrender of the cards by placing them under the call bet, the dealer gives the player two cards from the top of the deck.

The dealer asks each player, from the dealers left to his right to choose one of the four options. Once all players have chosen an option, placed their bets, and received their draw cards, the dealer takes three additional cards face-up from the top of the deck. These cards are placed at a trio of dealer's card boxes 24*a*, 24*b*, and 24*c*. If any of the dealer's new cards are the Padukee card, his hand is automatically declared dead and all of the remaining players win. "Former" players, i.e., those having previously chosen option one, and had their cards surrendered, are not considered to be "players" and do not win anything. All players with less than Three-Of-A-Kind in their hand remaining in the game are paid an amount equal to their ante plus the amount of the call bet. This is an even-money payout of the ante and call bet.

Players having Three-of-a-Kind or better are paid their original ante amount, plus an amount equal to their call bet and a bonus determined as a posted multiple of the call bet (Similar to Table 1). For instance, if the Player had a Straight Flush in his/her hand, that player would be paid an amount equal both to the ante and the call bet, plus an amount equal to 20 times the call bet (See TABLE 1).

The bonus award adds to the enjoyment of the game by increasing the amount of return a player might expect from each hand. In Padukee draw, better hands are rewarded with different multiples of the call bet. A straight flush might payout a 20:1 return on the original call bet, whereas a Full House might only payout 8:1. These payout schedules are by way of example only and not by way of limitation only. The actual payouts might vary as desired by the "house" and are posted at the game table so that each player knows the exact winnings for every hand.

If, however, the dealer has no Padukee card, all players still in the game compete one-on-one against the dealer, their individual hand versus the dealer's hand. Winning hands are paid even money (1 to 1) on the total of the ante and call bet. In addition, winning hands of greater than Three-of-a-Kind also qualify for a bonus award, wherein they are paid even money on the ante, but are paid a posted multiple (as discussed above) on the call bet. The posted multiple advantageously varies with the odds of obtaining each winning hand. In the preferred embodiment of this invention the ante bet itself does not earn any bonuses.

It will be appreciated that other embodiments of the draw game of the present invention can be played with more than one Padukee card. In such an embodiment, a player with four ranks of four suits would still automatically win against the dealer, since the dealer could not beat this hand. If the dealer draws a Padukee card, his hand is automatically declared dead. For example, the player having the highest possible Padukee poker hand (four ranks of four suits) might win a greater bonus than another player with a similar hand. For instance, a Padukee poker hand having an Ace (Hearts), Queen (Clubs), Jack (Spades), Ten (Diamonds) and the Padukee card would outrank a hand having a Ten (Hearts), Nine (Clubs), Six (Diamonds), Four (Spades) and the Padukee hand. In the case of multiple Padukee cards, the player holding the highest card in his/her hand might win the greatest payout.

Other embodiments of the Padukee draw game are also anticipated. For instance, the dealer might not automatically lose if his/her hand contains the Padukee card. The game would simply progress until the end when each player compared his hand to the dealer by standard poker rankings. In the case of multiple Padukee cards, a player could beat a dealer's Padukee hand by having a higher Padukee hand as discussed above.

In other embodiments of playing the game of the present invention, the bonus schedule could be altered to require either hands ranking less than Three-of-a-Kind (i.e., two pair) or greater than Three of a Kind (i.e., full house). This alteration in the game is anticipated to be within the scope of the present invention.

In yet another alternate method of playing Padukee Draw, the call bet could be either greater or lesser than the amount of the original ante. This would allow players that felt very confident with their hands to bet higher amounts, and players that were unsure of their position to bet lower amounts.

Still other variations of the game might include the dealer's first up card not being declared as a pair. This would lower the chances of the house winning by decreasing the ranking of the dealer's hand. The dealer would then draw four cards in the process of the game instead of three cards as discussed in the preferred embodiment.

Variations that include side betting during the process of the game are also anticipated. For example, a player might make a one dollar or more side bet that he draws a "high" Padukee hand (ACE, KING, QUEEN, JACK, PADUKEE) in the first five cards. Casinos would be able to promote this type of betting with very large payouts due to the large odds against getting such a hand. In addition, the side bet might be incorporated into the minimum ante. For example, with a ten dollar minimum ante, one dollar (or more) would go towards the major jackpot. This manner of betting would only require the player to actually place a single bet, thereby making the game less complex to play. Other hands could also be designated winners in the side bet with payouts being correlated to the odds of obtaining the hand in the first five cards.

Other variations on the Padukee hand are also anticipated. A "Padukee Flush" would comprise four cards of the same suit and the Padukee card. In this manner, a Player with four Spades and the Padukee card would be designated as a winner. Of course, four cards from any suit would qualify in this hand.

In addition, other embodiments of the preferred playing table are also anticipated. Other tables that are similar in design to FIG. 1 could be used to play the card game of the present invention. For example, a special box denoting that one card is a pair might not be included in the table design. Similarly, the call bet boxes 18, 20, 22 might be of different geometric design, or not included at all. It should be understood that the game of the present invention is not limited by the table it is played upon. One of ordinary skill in the art will recognize that Padukee card games can be effectively played on any surface suitable for card games. It can also be appreciated that there are almost endless variations on the theme of the card game of this invention. The present invention includes all card games wherein a standard fifty-two card deck is used with one or more additional unique cards, wherein the unique cards do not have any assigned rank or suit, nor are they wild. The unique cards are used to create new card hands that win over other predetermined poker or other ranked hands. Although many examples of the present invention have been disclosed herein, one should recognize that the scope of the true invention is not limited to these examples, but only to the following claims.

We claim:

1. A method of playing a card game comprising the steps of:
   (a) a player anteing a first bet means;
   (b) a dealer dealing a predetermined number of cards to said player and a single first card to himself from a card deck having at least one unique card in addition to the standard fifty-two cards, said unique card having no face value, nor being a wild card;
   (c) the player either folding in which case the player loses the first bet, or betting a second bet means;
   (d) the dealer dealing to himself at least three additional cards; and
   (e) said player and said dealer then comparing their best five cards using poker rank as the criterion for comparison, the dealer counting the first card dealt to himself as two cards of the same value and said player automatically winning if said player has a predetermined hand including said unique card.

2. The method of claim 1, wherein said predetermined number of cards is five.

3. The method of claim 1, wherein said dealer automatically loses if said first card, or any of said three additional cards is said unique card.

4. A method of playing a poker game comprising the steps of:
   (a) a player anteing a first bet means;
   (b) a dealer dealing a predetermined number of cards to said player from a card deck having at least one unique card in addition to the standard fifty-two cards, said unique card having no face value, nor being a wild card;
   (c) the dealer then dealing at least one card to himself, wherein if any of these cards are the unique card, the dealer loses the poker game;
   (d) the player either folding in which case the player loses the first bet means, or betting a second bet means;
   (e) said player and said dealer then comparing their best five cards, wherein if the player has four cards of different suits and the unique card, but no pairs, said player automatically winning the game; and
   (f) said player and said dealer then comparing their best five cards using poker rank as the criterion for comparison.

5. The method of claim 4, wherein as part of step (c), said dealer pays said player an amount equal to said first bet means if said dealer has said unique card, and pays said player an additional amount if said player has a hand having a value greater than a predetermined hand.

6. A method of playing a poker game comprising the steps of:
   (a) a player anteing a first bet means;
   (b) a dealer dealing five cards to said player from a card deck having at least one unique card in addition to the standard fifty-two cards, said unique card having no face value, nor being a wild card;
   (c) the dealer then dealing one first card to himself, wherein if this first card is the unique card, the dealer loses the poker game;
   (c) the player either folding in which case the player loses the first bet means, or betting a second bet means;
   (d) the player then having the option of trading in up to two cards for new cards from said card deck;
   (e) the dealer then dealing himself an additional three cards;
   (f) said player and said dealer then comparing their best five cards, wherein if the player has four cards of different suits and the unique card, but no pairs, said player automatically winning the game; and
   (g) said player and said dealer then comparing their best five cards using poker rank as the criterion for comparison.

7. A method of playing a card game comprising the steps of:
   (a) a player anteing a first bet means;
   (b) a dealer dealing two cards to said player from a card deck having at least one unique card in addition to the standard fifty-two cards, said unique card having no face value, nor being a wild card;
   (c) the dealer dealing two cards to himself, wherein if either of these cards is the unique card, the dealer loses the game.;
   (d) the player either folding in which case the player loses the first bet, or requesting at least one additional card;
   (e) the dealer then dealing himself at least one card until the sum total of the ranks in his hand are at least seventeen; and
   (f) said player and said dealer then comparing their cards, wherein the sum value of the ranks in each hand are determined, and the hand with a sum value that is closest to twenty-one without being grater than twenty-one is declared the winner.

8. The method of claim 7, wherein if said player has a hand comprising five cards, at least one of which is the unique card, and the sum value of the cards is less than twenty-one, then said player is automatically paid by the dealer.

9. A method of playing a poker game, comprising the steps of:
   (a) a player anteing a first bet means;
   (b) a dealer dealing a predetermined number of cards to said player from a card deck having at least one unique card in addition to the standard fifty-two cards, said unique card having no face value, nor being a wild card;
   (c) the dealer then dealing at least one card to himself;
   (d) if any of the dealer's cards are the unique card, paying said player an amount equal to said first bet means unless said player has a hand having a value greater than a predetermined hand, in which case said player is paid an amount greater than said first bet means depending on the value of the player's hand.

10. The method of claim 9, comprising the additional steps of:
   (e) if any of the dealer's cards is not the unique card, the player either folding or placing a second bet means;
   (f) at least said dealer taking one or more additional cards;
   (g) said dealer losing the game if any of said additional cards is said unique card.

11. The method of claim 10, comprising the additional steps of paying said player an amount equal to said first and second bet means unless said dealer received said unique card and said player has a hand having a value greater than a predetermined hand, in which case said player is paid an amount greater than said first and second bet means.

12. The method of claim 9, comprising the additional steps of said player placing a bonus bet means, and paying said player a bonus payout if said player has a hand with a value greater than a predetermined hand.

* * * * *